US012527388B2

(12) United States Patent
Brougher

(10) Patent No.: US 12,527,388 B2
(45) Date of Patent: Jan. 20, 2026

(54) NAIL POLISH APPARATUS

(71) Applicant: Karen Brougher, Spring, TX (US)

(72) Inventor: Karen Brougher, Spring, TX (US)

( * ) Notice: Subject to any disclaimer, the term of this patent is extended or adjusted under 35 U.S.C. 154(b) by 142 days.

(21) Appl. No.: 18/416,885

(22) Filed: Jan. 18, 2024

(65) Prior Publication Data

US 2025/0234976 A1 Jul. 24, 2025

(51) Int. Cl.

| | |
|---|---|
| ***A45D 29/00*** | (2006.01) |
| *A45D 34/00* | (2006.01) |
| *A47F 7/00* | (2006.01) |

(52) U.S. Cl.

CPC ..... *A45D 29/00* (2013.01); *A45D 2034/002* (2013.01); *A45D 2034/007* (2013.01); *A47F 7/0021* (2013.01); *A47F 7/0028* (2013.01)

(58) Field of Classification Search

CPC ..... A45D 29/00; A45D 2034/002; A45D 2034/007; A45D 34/00; A47F 7/00; A47F 7/0021; A47F 7/0028; A47F 5/00; A47F 5/0018

See application file for complete search history.

(56) References Cited

U.S. PATENT DOCUMENTS

| | | | | | |
|---|---|---|---|---|---|
| D120,872 | S | * | 6/1940 | Prouty | 47/41.01 |
| D221,725 | S | * | 9/1971 | Tatum | D99/36 |
| 4,932,802 | A | * | 6/1990 | Cantone | A45D 40/265 401/23 |
| D312,650 | S | * | 12/1990 | Charrier | 396/419 |
| 5,909,811 | A | * | 6/1999 | Harris | A45D 34/00 206/581 |
| 5,913,312 | A | * | 6/1999 | Donnell | A45D 34/00 132/73 |
| D441,914 | S | * | 5/2001 | Armour | D28/73 |
| D547,543 | S | * | 7/2007 | Dunn | D3/276 |
| D628,746 | S | * | 12/2010 | Peta | D28/61 |
| D704,890 | S | * | 5/2014 | Sturge | D28/61 |
| D958,928 | S | * | 7/2022 | Patterson | C02F 3/00 D23/207 |
| D990,782 | S | * | 6/2023 | Xu | D28/61 |
| 2004/0089774 | A1 | * | 5/2004 | Pace | A45D 34/00 248/146 |
| 2006/0150993 | A1 | * | 7/2006 | Lampugnale | A45D 34/06 132/75 |
| 2016/0081450 | A1 | * | 3/2016 | Kemeny, Jr. | A45D 34/045 206/457 |
| 2016/0295987 | A1 | * | 10/2016 | Boyle | A45D 29/00 |
| 2019/0320776 | A1 | * | 10/2019 | Davis | A45D 29/007 |
| 2022/0330685 | A1 | * | 10/2022 | Xu | A45D 29/00 |

* cited by examiner

*Primary Examiner* — Devin K Barnett
(74) *Attorney, Agent, or Firm* — Darryl Edwin Scott

(57) ABSTRACT

A nail polish holder having a sepal section. The sepal section has a concave base formed in an upward posture. A concave roof is formed in a downward posture, wherein the concave base and the concave roof are coupled together using a stitch such the sepal section forms an oval disc. A petal holder is coupled to the concave roof. A first petal forming a droplet is integrally coupled to a second petal forming a droplet. A third petal forming a droplet is integrally coupled to the second petal. A fourth petal forming a droplet is integrally coupled to the third petal. A fifth petal forming a droplet is integrally coupled to the first petal such that the first petal, the second petal, the third petal, the fourth petal, and the fifth petal forms a cavity for holding the nail polish tool.

5 Claims, 4 Drawing Sheets

Fig. 3
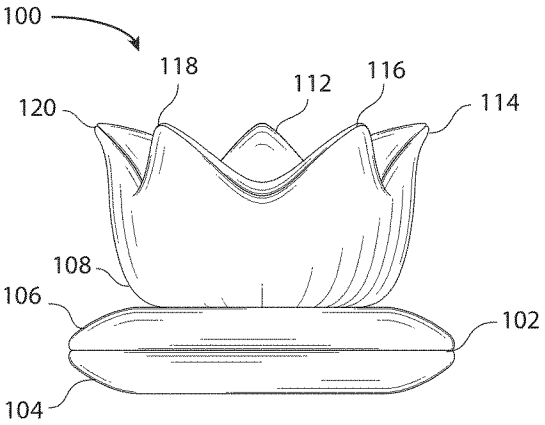
Fig. 5
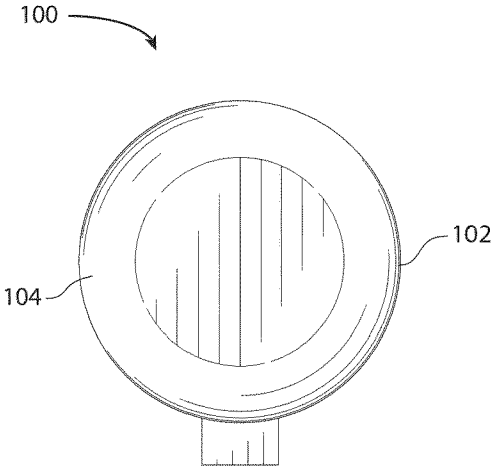
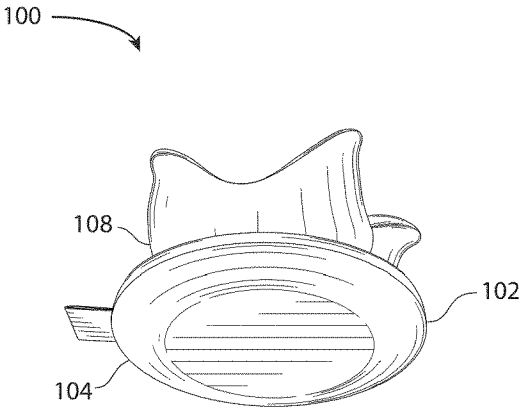
Fig. 2
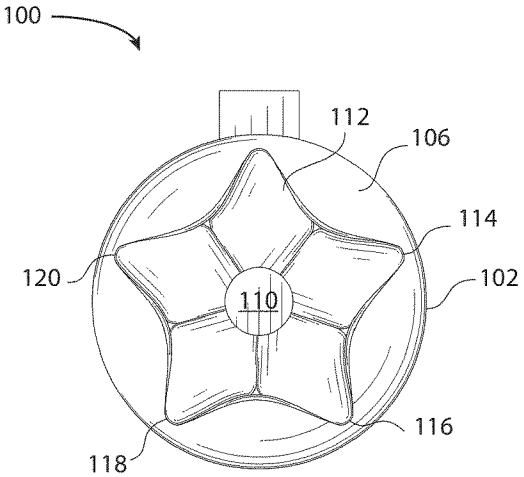
Fig. 4

NAIL POLISH APPARATUS

BACKGROUND

Applying nail polish can be messy and if mishandled can result in spillovers that often damage countertops and other household surfaces. Stabilizing the nail polish container while applying the polish onto the individual's nails is challenging. For example, when individuals attempt to apply nail polish the act of inserting the brush into the nail polish container often results in the container tipping over and spilling the contents. As result, there are enhancement products designed to hold nail polish containers in place. However, these enhancement products are not biodegradable and can be considered hazardous to the environment. Thus, providing a solution that is environmentally safe and prevents a nail polish container from tipping over is a challenge.

BRIEF DESCRIPTION OF THE DRAWINGS

FIG. 2 is a perspective view a bottom of a nail polish holder.

FIG. 3 is a profile view of a nail polish holder.

FIG. 4 is an aerial view of a nail polish holder.

FIG. 5 is a bottom view of a nail polish holder.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Applying fingernail polish independently can be messy and if mishandled can result in spillovers that often damage countertops and other household surfaces. For example, many individuals will insert the nail polish brush into a small container opening to reach the contents of the nail polish container. Removing or inserting the brush too quickly or at an incorrect angle could result in the container tipping over, thus spilling the contents of the container. Holding the nail polish container can be problematic as well, because the individual is trying to stabilize their hand in a set position so that the nail polish can be applied evenly and allowed to dry. Thus, leaving the nail polish container unsecured on a surface and vulnerable to tipping over.

The embodiments disclosed herein describes a biodegradable apparatus that provides stable support to a nail polish tool. Note, the nail polish tool herein shall refer to a nail polish brush, a nail polish container, and nail polish content. The nail polish holder may be made from cotton. More specifically, the nail polish holder may be made from biodegradable cotton batting. Further, the contents of the nail polish holder, which is hollow, may be filled with rice or other similar biodegradable source. The purpose of which to protect the environment from non-decomposable waste.

Figure 1:
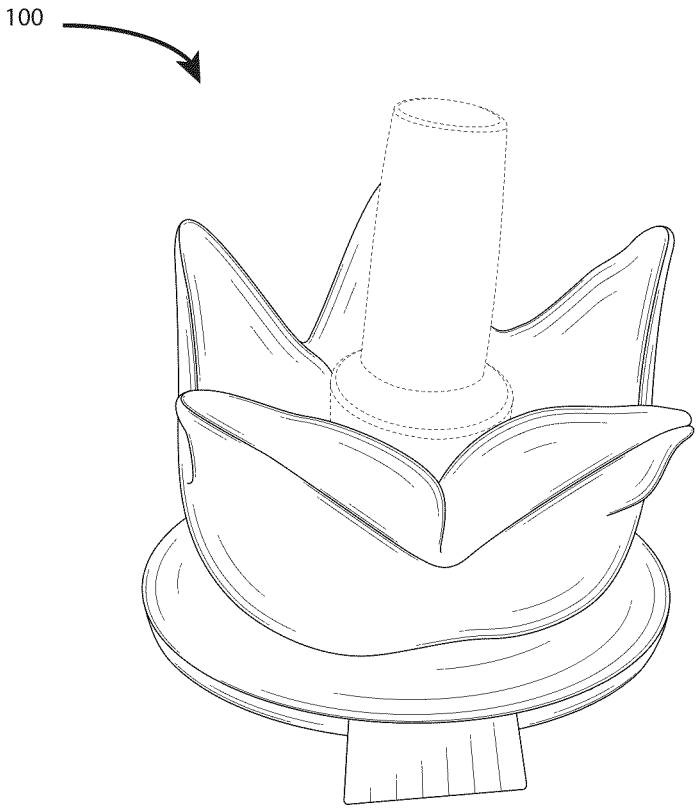
FIG. 1 is a perspective view of a nail polish holder and a nail polish tool.

FIG. 1 is a perspective view of a nail polish holder and a nail polish tool. As illustrated, the nail polish holder 100 has a nail polish tool (illustrated in dashed lines) safely secured within the nail polish holder 100. Having the nail polish tool safely secured in the nail polish holder 100 allows an individual to avoid the potential of "tipping" the nail polish tool over and spilling the contents. The embodiments that safely secure the nail polish tool are described in connection with FIGS. 2-5.

FIG. 2 is a perspective view a bottom of a nail polish holder. FIG. 3 is a profile view of a nail polish holder. FIG. 4 is an aerial view of a nail polish holder. FIG. 5 is a bottom view of a nail polish holder. As illustrated in FIGS. 2-5, the nail polish holder 100 may include a sepal section 102. The sepal section 102 is the oval disc shaped based section of the nail polish holder 100. More specifically, the sepal section 102 is comprised of two sections that are stitched together to form the sepal section 102. The sepal section 102 includes a concave base 104 which is more clearly referenced in FIG. 3. Although illustrated in FIGS. 2, 3, and 5, FIG. 3 illustrates that the concave base 104 forms an upward posture creating a bowl shape. Similar to a bowl, the concave base 104 has a flat surface bottom that limits the nail polish holder 100 from tipping over. Connected to the concave base 104 is a concave roof 106. The concave roof 106 is more clearly illustrated in FIGS. 3 and 4. The concave roof 106 may form a downward posture such that it connects to the concave base 104 using biodegradable stitching. Similar to the concave base 104, the concave roof 106 also includes a flat surface that allows for the coupling of the petals which are described below.

As illustrated in FIGS. 1-3, the nail polish holder 100 includes a petal holder 108 coupled to the concave roof 106. The petal holder 108 is the section of the nail polish holder 100 that holds the nail polish tool in place. More specifically, the petal holder 108 forms a cavity 110 (illustrated in FIG. 4) that secures the nail polish tool in place. Comprised in the petal holder 108 are a series of petals formed in a circular array. For example, as illustrated in FIGS. 3 and 4, the petal holder 108 includes a first petal 112. The first petal 112 forms the shape of a typical flower petal or more descriptively a droplet shape (i.e., tear drop shape).

Integrally coupled to the first petal 112 is a second petal 114 that also forms a droplet shape. This pattern is repeated in that a third petal 116, forming a droplet shape, is integrally coupled to the second petal 114. A fourth petal 118, also forming a droplet shape, is integrally coupled to the third petal 116. Closing the petal holder 108, and thus creating the cavity 110 is a fifth petal 120, also forming a droplet shape, is integrally coupled to the first petal 112.

Figure 6:
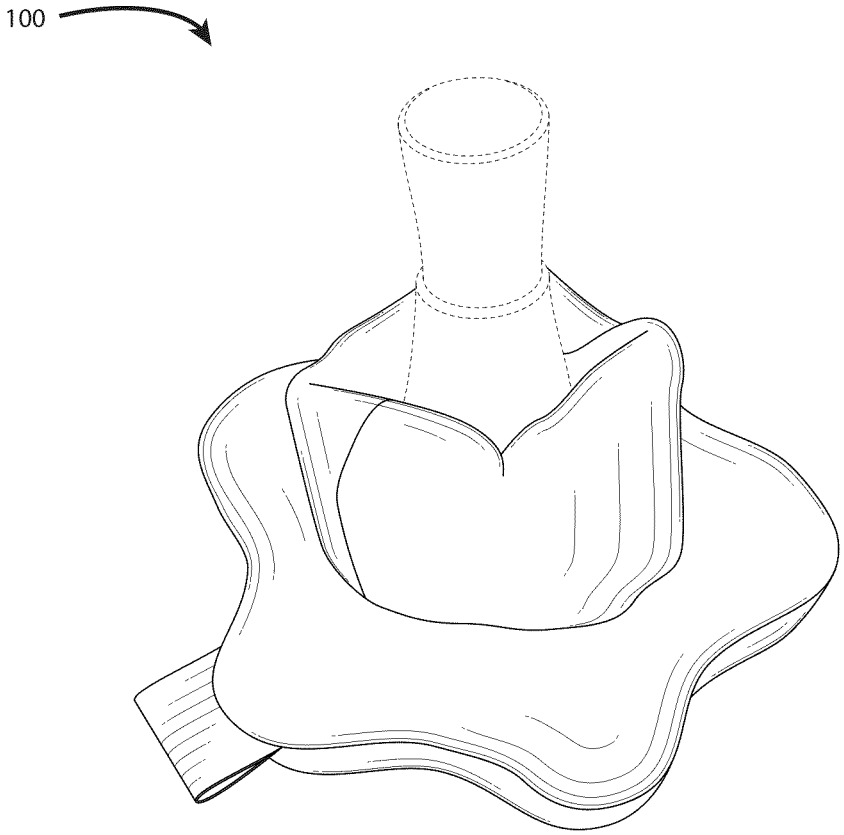
FIG. 6 is a perspective view of a variation of a nail polish holder and a nail polish tool.

The nail polish holder 100 may be formed in a different variation but serve the same functional purpose. For example, FIG. 6 is a perspective view of a variation of a nail polish holder and a nail polish tool. The nail polish holder

100 in FIG. 6 also secures the nail polish tool (illustrated in dash lines) such that potential spillage is restricted. Similarly, the embodiments that described the elements to secure the nail polish tool are described in FIGS. 7-10.

Figure 8:
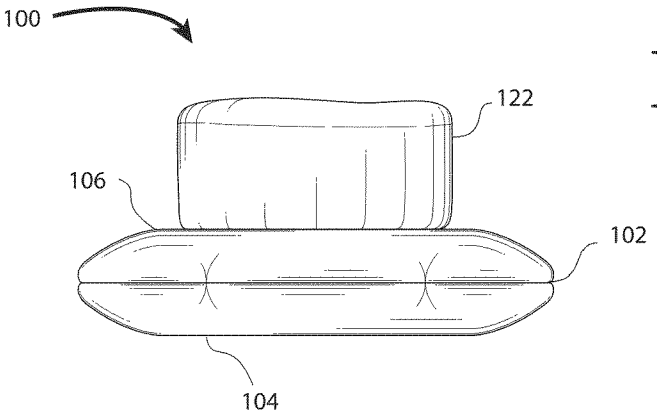
FIG. 8 is a profile view of a variation of a nail polish holder.
Figure 10:
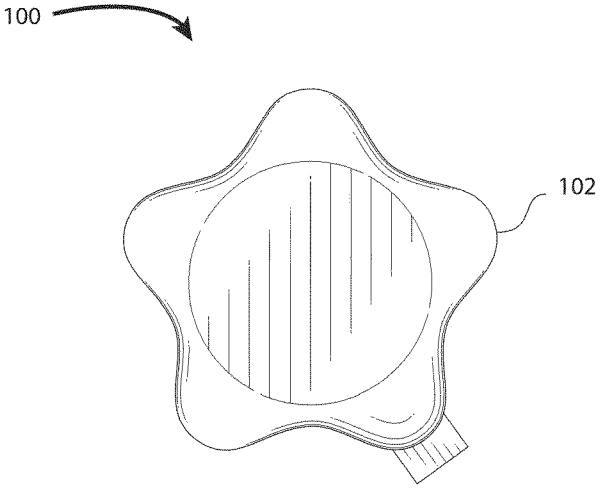
FIG. 10 is a bottom view of a variation of a nail polish holder.
Figure 7:
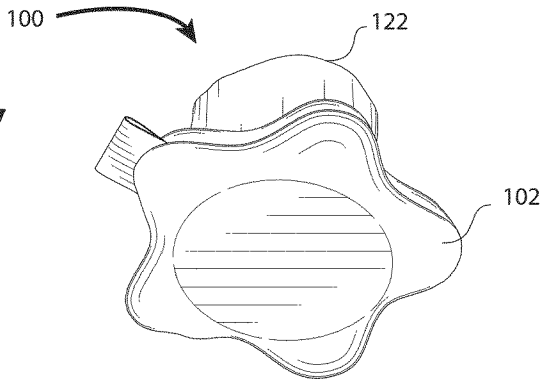
FIG. 7 is a perspective view of a bottom of a variation of a nail polish holder.
Figure 9:
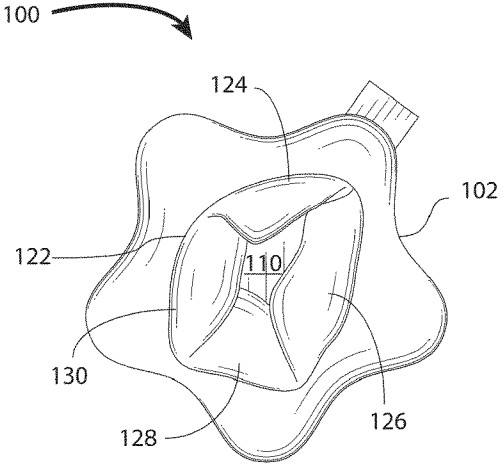
FIG. 9 is an aerial view of a variation of a nail polish holder.

For example, FIG. 7 is a perspective view of a bottom of a variation of a nail polish holder. FIG. 8 is a profile view of a variation of a nail polish holder. FIG. 9 is an aerial view of a variation of a nail polish holder; and FIG. 10 is a bottom view of a variation of a nail polish holder. The concave base 104 has the same structure as those described in connection to FIGS. 1-5, in that the concave base 104 forms an upward posture like a bowl. Further, and similarly, the concave roof 106 forms a downward posture such that the concave roof 106 couples to the concave base 104 by stitching and forms an oval or circular disc. However, as illustrated in FIGS. 8-10, the sepal section 102 has a slight variation in design. For example, the circular concave base 104 and circular concave roof 106 has five semi-circles integrally coupled to and extending from the circular concave base 104 and circular concave roof 106. Specifically, the sepal section 102 forms a five-pointed star wherein the vertices are rounded.

Mounted on and coupled to the sepal section 102 is a pod section 122. The pod section 122 is the portion of the nail polish holder 100 that secures the nail polish tool. As illustrated more clearly in FIG. 9, the pod section 122 has a first wall 124 and a second wall 126 adjacently and integrally coupled to the first wall 124. A third wall 128 is positioned adjacently and integrally coupled to the second wall 126. To form the cavity 110 that is used to secure the nail polish tool, a fourth wall 130 is positioned adjacently and integrally between the third wall 128 and the first wall 124.

In one aspect, an apparatus for holding a nail polish tool includes a sepal section. The sepal section has a concave base that forms an upward posture. The sepal section has a concave roof that forms a downward position such that the concave base and concave roof are coupled together using a stitch such that the sepal section forms an oval disc. A petal holder is coupled to the concave roof. The petal holder has a first petal forming a droplet. A second petal forming a droplet is integrally coupled to the first petal. A third petal forming a droplet is integrally coupled to the second petal. A fourth petal forming a droplet is integrally coupled to the third petal. A fifth petal forming a droplet is integrally coupled to the first petal such that the first petal, the second petal, the third petal, the fourth petal, and the fifth petal forms a cavity for holding the nail polish tool.

Implementation may include one or more of the following. The apparatus may be manufactured from cotton. The apparatus may be hollow. The apparatus may be filled with rice and cotton batting. The apparatus may be biodegradable.

In one aspect, an apparatus for holding a nail polish tool includes a sepal section. The sepal section has a circular concave base formed in an upward posture. The circular concave base has five semi-circles integrally coupled to and extending from the circular concave base. A circular concave roof forms a downward posture. The circular concave roof has five semi-circles integrally coupled to and extending from the circular concave roof such that the circular concave base and the circular concave roof are coupled by stitching. A pod section is coupled to the circular concave roof. The pod section has a first wall. A second wall is adjacently and integrally coupled to the first wall. A third wall is adjacently and integrally coupled to the second wall. A fourth wall is adjacently and integrally coupled to the first wall such that the first wall, the second wall, the third wall, and the fourth wall forms a cavity for holding the nail polish tool.

Implementation may include one or more of the following. The apparatus may be manufactured from cotton. The apparatus may be hollow. The apparatus may be filled with rice and cotton batting. The apparatus may be biodegradable.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for holding a nail polish tool comprising:
- a sepal section, the sepal section having:
  - a concave base formed in an upward posture; and
  - a concave roof formed in a downward posture; wherein, the concave base and concave roof are coupled together by a stitch such that the sepal section forms an oval disc;
- a petal holder coupled to the concave roof, the petal holder having:
  - a first petal that defines a first droplet;
  - a second petal that defines a second droplet and is integrally coupled to the first petal;
  - a third petal that defines a third droplet and is integrally coupled to the second petal;
  - a fourth petal that defines a fourth droplet and is integrally coupled to the third petal; and
  - a fifth petal that defines a fifth droplet and is integrally coupled to the first petal; wherein the first petal, the second petal, the third petal, the fourth petal, and the fifth petal forms a cavity for holding the nail polish tool.

2. The apparatus of claim 1 wherein the apparatus is manufactured from cotton.

3. The apparatus of claim 1 wherein the apparatus is hollow.

4. The apparatus of claim 3 wherein the hollow is filled with rice and cotton batting.

5. The apparatus of claim 1 wherein the apparatus is biodegradable.

* * * * *